United States Patent [19]

Strickland

[11] 4,308,918

[45] Jan. 5, 1982

[54] BLOWOUT PREVENTER

[75] Inventor: William N. Strickland, Houma, La.

[73] Assignee: Bonnie Corp., Houma, La.

[21] Appl. No.: 165,224

[22] Filed: Jul. 1, 1970

Related U.S. Application Data

[63] Continuation-in-part of Ser. No. 92,573, Nov. 8, 1979.

[51] Int. Cl.[3] ..... E21B 33/06; E21B 33/126; E21B 33/128

[52] U.S. Cl. ..... 166/326; 166/196; 166/202; 175/325; 251/1 R

[58] Field of Search ..... 166/325, 319, 326, 119, 166/121, 192, 202, 196, 179, 363; 175/325, 321, 320, 25; 251/1 R

[56] References Cited

U.S. PATENT DOCUMENTS

| | | | |
|---|---|---|---|
| 2,449,642 | 9/1948 | Coons | 166/325 X |
| 2,669,305 | 2/1954 | Condra | 166/196 X |
| 2,696,263 | 12/1954 | O'Donnell | 166/202 X |
| 3,151,690 | 10/1964 | Grable | 175/321 |
| 3,724,541 | 4/1973 | Curry | 166/325 |

*Primary Examiner*—Stephen J. Novosad

*Attorney, Agent, or Firm*—Charles C. Garvey, Jr.

[57] ABSTRACT

A blowout preventer assembly for sealing off a well blowout within the confines of the drill stem is disclosed. The blowout preventer assembly comprises an elongated collar member which is located around and is slidable along a section of the drill pipe. Each end of the collar member has an expandable portion made of rubber or the like, which is capable of being expanded to the width of the drill pipe casing. Fixedly attached to the section of drill pipe at a location above the slidable collar member is a rigid metal collar section having around its circumference a plurality of equally-spaced wing flanges tapering down from a right angle at the top of the fixed collar to a slope at the lower end thereof. The sudden pressure surge of the blowout forces the slidable member upwardly so that the rubberized end portion thereof engages and is expanded outwardly into contact with the inner wall of the well casing by means of the sloping flange wings of the fixed collar, thus sealing off the space between the drill pipe and well casing, and in effect, stopping the surge of the blowout at that point.

7 Claims, 6 Drawing Figures

BLOWOUT PREVENTER

REFERENCE TO RELATED APPLICATION

This is a continuation-in-part of my prior co-pending patent application U.S. Ser. No. 92,573, filed Nov. 8, 1979.

BACKGROUND OF THE INVENTION

1. Field of the Invention

The present invention relates to oil well blowout preventers, and in particular to an automatic blowout preventer located within the drill stem and comprised of a slidable tubular member located between the drill pipe and drill casing which, when impacted by a blowout within the drill stem would force the slidable member upward so that its expandable end would engage with a fixed flanged collar section and would expand to fill the gap between the drill pipe and drill casing to interrupt the flow of the blowout within the drill stem.

2. General Background and Prior Art

In the field of oil and gas drilling, the most feared and dreaded occurrence would be that in the middle of a drilling for oil and gas that a blowout occur within the drill stem, creating an extreme pressure surge at the blowout upward through the drill stem and would eventually erupt through the drill floor, in most cases resulting in extreme damage to the entire drill rig assembly, and very often resulting in injury and death to workers on the drill platform, and in effect causing a shut down of the entire rig and the loss of valuable time, money and man hours.

Numerous devices have been installed within the drill assembly mechanism to assist in helping to prevent or to short circuit a blowout. However, it is recognized in the art that the most successful blowout preventer would be one which acted while the blowout is still confined within the drill stem, so that the pressure of the blowout would not have an impact upon the drill assembly above ground.

These problems are discussed in my prior co-pending patent application U.S. Ser. No. 92,573 filed Nov. 8, 1979 and incorporated herein by reference.

GENERAL DESCRIPTION OF THE PRESENT INVENTION

The apparatus of the present invention would provide a down-hole blowout preventer apparatus for sealing off the blowout within the confines of the drill stem. In particular, the apparatus would comprise a slidable elongated collar member which would be located around the drill pipe and have the ability to slide along the section of drill pipe from end to end. Each end of the member would be equipped with an expandable portion, constructed of rubber or the like, which when necessary would have the ability to expand to the width of the drill pipe casing. A second fixed collar portion would be fixedly attached to the section of drill pipe, preferably located immediately below the upmost connective of that section of pipe. This fixed collar section would be of a rigid metal, adapted around its circumference with a plurality of equally spaced wing flanges, each wing flange tapering down from a right angle at the top of the collar to a slope at the lower end of the section. In the event of a blowout occurring below the section of pipe adapted with the preventer apparatus, the surge of the blowout would force the slidable member to travel upward within the drill stem ahead of the surge. Upon the expandable end of the slidable ring section reaching the fixed collar flange section, the rubberized end would engage the sloping flange wings and expand outward as it moved upward around the flanges of the ring. The rubber portion would then be expanded to a point that the upper edge would be in direct contact with the inner wall of the drill pipe casing, thus, in effect, sealing off the space between the drill pipe and drill casing, and in effect stopping the surge of the blowout at that point. Also, it should be noted that as the expandable rubber end would engage tightly between the top edge of the gussets and the inner wall of the drill casing, whatever fluids from the blowout would seep through the space between the slidable seal member and the drill pipe would be sealed off due to the fact that the point at which the rubberized expandable end section is attached to the metal of the slidable member would bear against the lower portion of the fixed flanged collar portion and, in effect, create a seal at that point also. Therefore, whatever space was available for the blowout surge to seep through would, in effect, be sealed off and the blowout would be stopped at that point. Therefore, it is one object of the invention to provide a blowout preventer apparatus which would short circuit a blowout while the blowout is within the confines of the drill stem.

It is another object of the present invention to provide a blowout preventer system that would be relatively easy to install and relatively easy to manufacture and equip a drill rig with.

It is another object of the present invention to provide a blowout preventer system that could be located at various points along the drill string so that should a blowout occur at any point below that apparatus, the blowout would be stopped at that point.

It is another object of the present invention that a blowout preventer system be installed within the drill stem yet still allowing the drill pipe sections to be removed and replaced without having to engage extra expense, etc., in removing the blowout preventer apparatus system.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
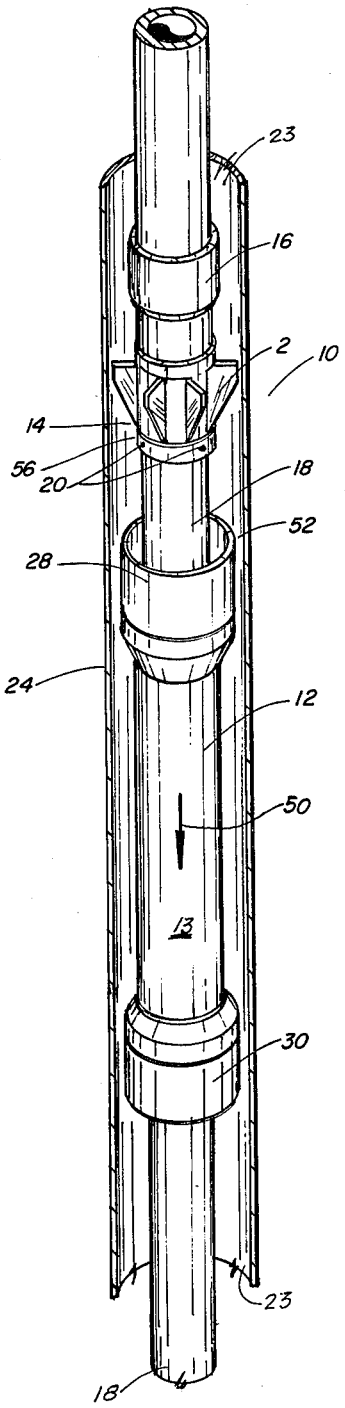
FIG. 1 is a perspective view of the entire blowout preventer apparatus as it would occur in the drill stem prior to a blowout occurring.

FIG. 1 shows best the preferred embodiment of the present invention designated generally by the numeral 10. Blowout preventer 10 comprises sealing member 12 and fixed spread collar 14. In FIG. 1 there is illustrated spread collar 14 fixedly attached to the outer wall of drill string 18 by for example a series of screw attachments 20. The entire apparatus 10 would be situated in that area between drill string 18 and casing 24. As will be described more fully hereinafter, sealing member 12 will normally rest against a drill pipe joint (which is of a larger diameter than drill string itself) but will be thrust upwardly during a blowout condition abutting spread collar 14 to seal the well (see FIG. 2).

Figure 2:
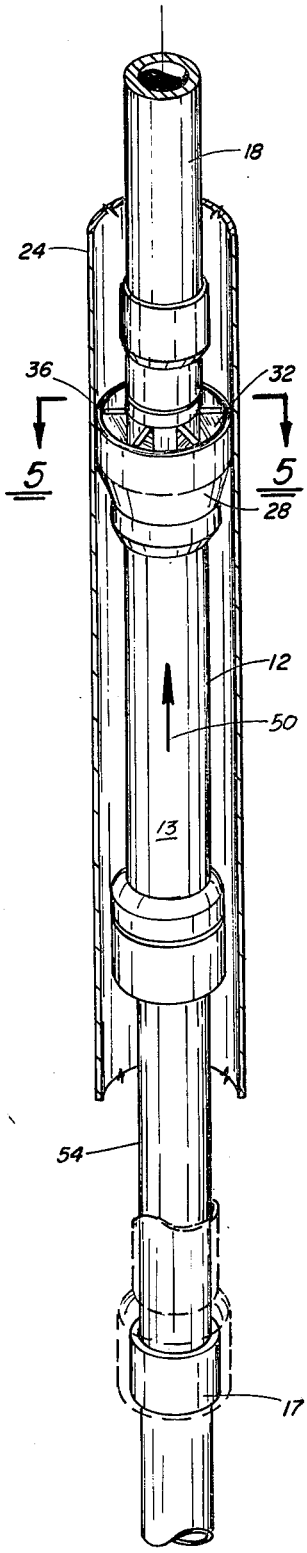
FIG. 2 is a perspective view of the entire blowout preventer apparatus as it is engaged during the occurrence of a blowout.
Figure 4:
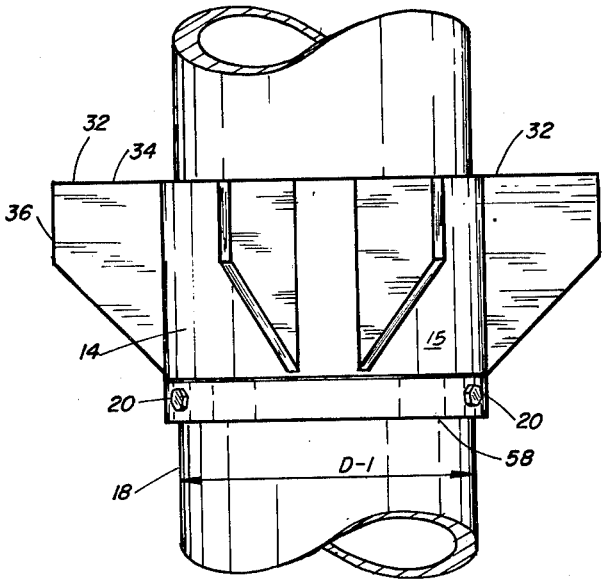
FIG. 4 is a perspective view of the stationary ring member section with flanges.
Figure 5:
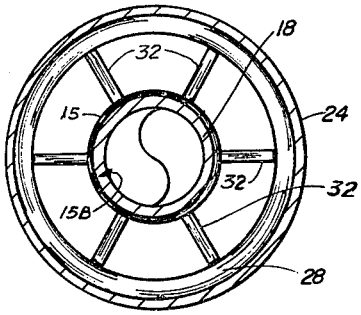
FIG. 5 is a sectional view taken along lines 5—5 of FIG. 2.

FIGS. 2 and 4 illustrate more particularly the construction of seal member 12 and spread collar portion 14. Slideable member 12 is equipped a cylindrical seal shaft 13 having at its end portions upper and lower concentrically expandable cup sections 28, 30. Expandable sections 28, 30 being positioned at either end of the slideable member 12, would enable it to be placed on the drill pipe on either end, with the bottom end of the member 12 having the flared section act as a receiver end for the surge of a blowout as it would move upward on drill string 18.

FIGS. 1 and 4 illustrate in perspective spread collar 14 as it attaches to drill pipe 18 directly beneath a joint 16 drill pipe. Fixed collar 14 comprises a central preferably cylindrical hub 15 having an inner bore 15B which is of an internal diameter equal to or slightly larger than the outer diameter of drill string 18. Collar 14 is adapted with a plurality of flanged gusset sections 32 which each have a top edge 34 parallel with the top edge of the collar and with the side edge 36 at a right angle to top edge 34 for a short distance, then sloping at bevelled edge 33 down at (for example) a 45° angle to the bottom portion of wing collar 14. Such a structure of flanges 32 is provided for spreading expandable Section 28 or 30 during the occurrence of a blowout. (See FIG. 2). Spread collar 14 is fixedly attached by screw for example 20 to the outer edge of the drill pipe 18. This can be accomplished while the drill pipe is still above ground wherein the slideable member would be positioned on the drill pipe and the fixed collar section would be fixed at that point on the drill pipe section prior to its being lowered into the drill string.

Figure 3:
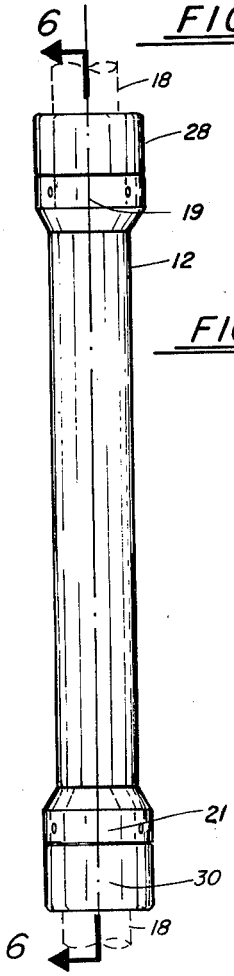
FIG. 3 is a perspective view of the slideable member section of the apparatus.
Figure 6:
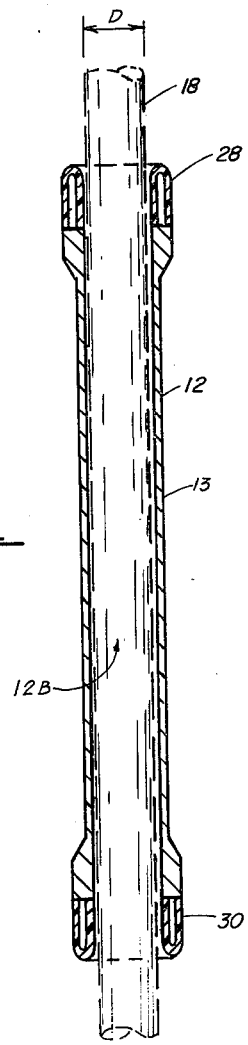
FIG. 6 is a sectional view taken along lines 6—6 of FIG. 3.

FIGS. 3 and 6 shows more particularly the construction of seal member 12 which is slideably mounted during operation on drill string 18. Seal member 12 provides a hollow or bored shaft 13, preferably cylindrical with a uniform cylindrical bore 12B. Bore 12B is preferably of a slightly larger inner diameter than the outer diameter D-1 of drill string 18. This allows a sliding attachment of seal member 12 upon the drill string 18. In this sliding position upon the drill string 18, seal member 12 will actually only move up and down upon one joint of drill pipe between a normal lower resting position and an upper sealing stop position (during a blowout condition). Enlargements in diameter of the drill string (at an assembly joint 16) will perform as a stop, defining the lower resting position of seal member 12 while spread collar 14 will provide an enlargement defining the upper stop position of seal member 12 (as seen in FIG. 2). In FIGS. 1 and 2, seal member is shown in phantom lines at the lower resting position upon joint 17.

Note that expandable sections 28, 30 have a smaller O.D. when in a normal contracted position (FIG. 1), allowing well drilling fluids and the like to pass thereby. However, when expanded as seen with expandable section 28 in FIG. 2, a seal disallows the passage of well fluids thereby.

Expandable sections 28, 30 are provided at each end of shaft 13, so that seal member 12 is reversible. Flanges 19, 21 affix by welding for example to the ends of shaft 13, with expandable sections being attached to flanges 19, 21 by bolting, riveting, gluing or like conventional means for attaching rubber to steel. In the preferred embodiment, expandable sections 28, 30 would be of neoprene for example, with shaft 13, and spread collar of suitable structural material as steel for example.

FIG. 1, taken in conjunction with FIG. 2 would show in sequence the apparatus of the present invention as it would be in operation prior to and after the occurrence of a blowout condition in the well. It should be noted that FIG. 1 illustrates seal 12 as it would be positioned on the section of drill pipe 18 prior to the occurrence of a blowout. Seal member 12 would normally be slideable up and down on drill string 18. As a blowout would occur at the lower end of drill string 18, the surge of the blowout as indicated by arrow 50 in FIG. 1 would move the slideable seal member 12 upward. Expandable section 28 then engages gussets 32 on spread collar portion molding around the bevelled edge 33 of gussets 32 positioning itself there around, so that the space between the outer edge 36 of gussets 32 and the inner wall 23 of casing 24 are in contact at all points around the inner wall 23 of casing 24. This positioning of the expandable rubberized end caused by the force of the blowout would, in effect, seal that space 52 between casing 24 and drill pipe 18 as seen in FIG. 1 with the upper edge of the expandable section 28.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A blowout preventer apparatus for use in drilling oil/gas wells comprising:

a. a length of casing having a casing bore placed at least in part within the bore of the oil/gas well being drilled;

b. a drill string extended into the well bore and penetrating during the drilling operation the casing bore;

c. a stop affixed during operation to said drill string and defining thereon an upper "stop" position; and d. casing bore sealer means slideably mounted on said drill string below said stop between a lower "resting" and said upper "stop" positions for sealing at least a part of said casing bore during a well blowout condition responsive to upward movement of said seal means from said lower "resting" to said upper "stop" position, and said casing bore sealing means comprises at least in part a cylindrical seal shaft slideably movable on said drill string, said shaft having at its upper portion an expandable seal which expands during operation when said shaft rises responsive to a blowout condition and engages said stop.

2. The blowout preventer apparatus of claim 1, wherein said stop comprises a spread collar affixed during operation to said drill string, said collar in part projecting laterally from said drill string towards said casing, and said sealer means comprises at least in part an expandable section which expands responsive to a blowout condition when said sealer means and said spread collar become engaged.

3. The blowout preventer apparatus of claim 1, wherein said sealer means comprises at least in part an expandable collar movable with said casing bore sealer means, and said stop comprises at least in part spreader means on said stop for expanding said collar when said sealer means engages said stop responsive to a blowout condition.

4. The blowout preventer apparatus of claim 1, wherein said stop comprises a cylindrical hub and a plurality of laterally extending gusset plates attached circumferentially to said hub, each of said gusset plates being radially placed about said hub and extending a partial distance from said hub to the inner wall of said casing.

5. The blowout preventer apparatus of claim 4, wherein each of said gusset plates provides a lower beveled section facing downwardly toward said sealer means during operation.

6. The blowout preventer apparatus of claim 1, wherein said sealer means comprises a cylindrical shaft having an inner cylindrical bore, said bore during operation being slideably mounted upon said drill string, and a pair of expandable resilient collars mounted respectively at the end portion of said shaft, each of said collars being expandable in a lateral direction generally away from the central axis of said shaft bore.

7. The apparatus of claim 1 wherein said lower resting position is an enlarged section of said drill string.

* * * * *